United States Patent [19]

Horhold et al.

[11] 3,992,203

[45] Nov. 16, 1976

[54] POLYPHENYLENEVINYLENE PHOTOCONDUCTOR COMPOSITION SENSITIZED WITH A 1,4-BIS (STYRYL) BENZENE DERIVATIVE

[75] Inventors: Hans-Heinrich Hörhold; Joachim Gottschaldt; Regina Bergmann; Johannes Opfermann, all of Jena; Walter Seliger, Dresden; Siegfried Augst, Dresden; Hartmut Arnstadt, Dresden, all of Germany

[73] Assignee: Veb Pentacon Dresden, Germany

[22] Filed: Apr. 18, 1975

[21] Appl. No.: 569,577

[30] Foreign Application Priority Data

May 16, 1974 Germany .....31785/45
Nov. 28, 1974 Germany .....24511/58

[52] U.S. Cl. ..... 96/1.5; 96/1.6; 252/501

[51] Int. Cl.[2] ..... G03G 5/06

[58] Field of Search ..... 96/1.5, 1.6, 1.8; 252/501

[56] References Cited

FOREIGN PATENTS OR APPLICATIONS 1,345,692 1/1974 United Kingdom ..... 96/1.5

OTHER PUBLICATIONS

Chem. Abstracts, vol. 81, Col. 153083b, vol. 80, Col. 84743g, vol. 74, Col. 77417b.

*Primary Examiner*—John D. Welsh
*Attorney, Agent, or Firm*—William A. Drucker

[57] ABSTRACT

Electrophotographic recording material is disclosed comprising at least one polyphenylenevinylene having a molecular weight greater than 2,000 g/mol and at least one 1,4-bis (styryl) benzene derivative.

3 Claims, 1 Drawing Figure

POLYPHENYLENEVINYLENE PHOTOCONDUCTOR COMPOSITION SENSITIZED WITH A 1,4-BIS (STYRYL) BENZENE DERIVATIVE

BACKGROUND OF THE INVENTION

The invention relates to an electrophotographic recording material which consists of polyphenylenevinylenes and low-molecular organic additions.

Polyphenylenevinylenes consist of a conjugated sequence of unsubstitued or substituted phenylene and vinylene structure members which can be arranged in alternation according to formula (1) or not alternating according to formula (2).

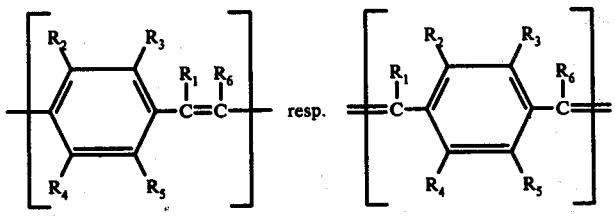

(1)

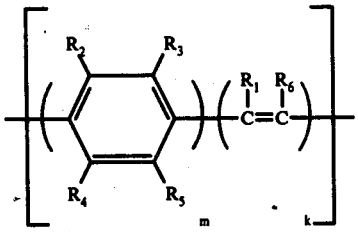

(2)

A plurality of alternating polyphenylenevinylenes, known as polyxylylioenes according to formula (1) is already known. They differ from one another by the nature and position of the substituents $R_1$ to $R_6$ and by the succession of variously substituted blocks. Furthermore cocondensates are known which correspond to formula (2).

Apart from structure features such as arrangement, relationship of the blocks and nature of the substituents R, the mean molecular weight must also be used for the characterisation of these polymers. Such polyphenylenevinylenes are photoconductive, possess a high dark resistance and have already been proposed, beside other low molecular and polymeric organic photoconductors, for use for electrophotography. Several such polyphenylenevinylenes, for example those with $R_1$ and/or $R_6$ equal to phenyl, are soluble and can be processed into coatings.

On account of the low characteristic sensitivity of almost all organic photoconductors, additions of dyestuffs and/or electron acceptors as sensitisors have been proposed for the production of sensitive electrophotographic coatings.

Both types of sensitisor often however possess the disadvantage that their chemical and photochemical stability is not satisfactory. For example some dyestuff additives bleach out, like the merocyanine dyestuffs, or chemical modifications of the coatings occur in storage or use, as in the case of use of Lewis acids or strong electron acceptors (tetracyanoethylene). Moreover a series of additives which have been proposed to increase sensitivity in organic polymeric photoconductors leads to a deterioration of the optical properties, especially of homogeneity (transparency and lightpermeability in the visible range, detrimental to the use).

OBJECT OF THE INVENTION

The problem of the invention is the production of a highly sensitive, optically homogeneous (transparent) electrophotographic recording material which possesses a favourable chemical and photochemical stability and forms self-supporting films or films which adhere well to ordinary conductive or non-conductive bases.

SUMMARY OF THE INVENTION

According to the invention there is provided an electrophotographic recording material comprising at least one photoconductive polyphenylenevinylene having a mean molecular weight greater than 2,000 g/mol in admixture with at least one 1,4-bis(styryl) benzene derivative.

The or each 1,4-bis(styryl)-benzene derivative may correspond to formula (3):

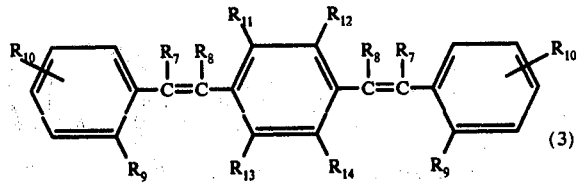

(3)

in which at least one of the radicals $R_7$ and $R_8$ signifies a cyano group and the remaining radicals $R_9$ to $R_{14}$ are similar or different and signify hydrogen, cyano, alkoxy, alkyl, aryl, halogen, nitro or amino groups. The proportion by mass of the additive according to formula (3) preferably amounts to 0.5% to 30%.

DESCRIPTION OF PREFERRED EMBODIMENTS

Figure 1:
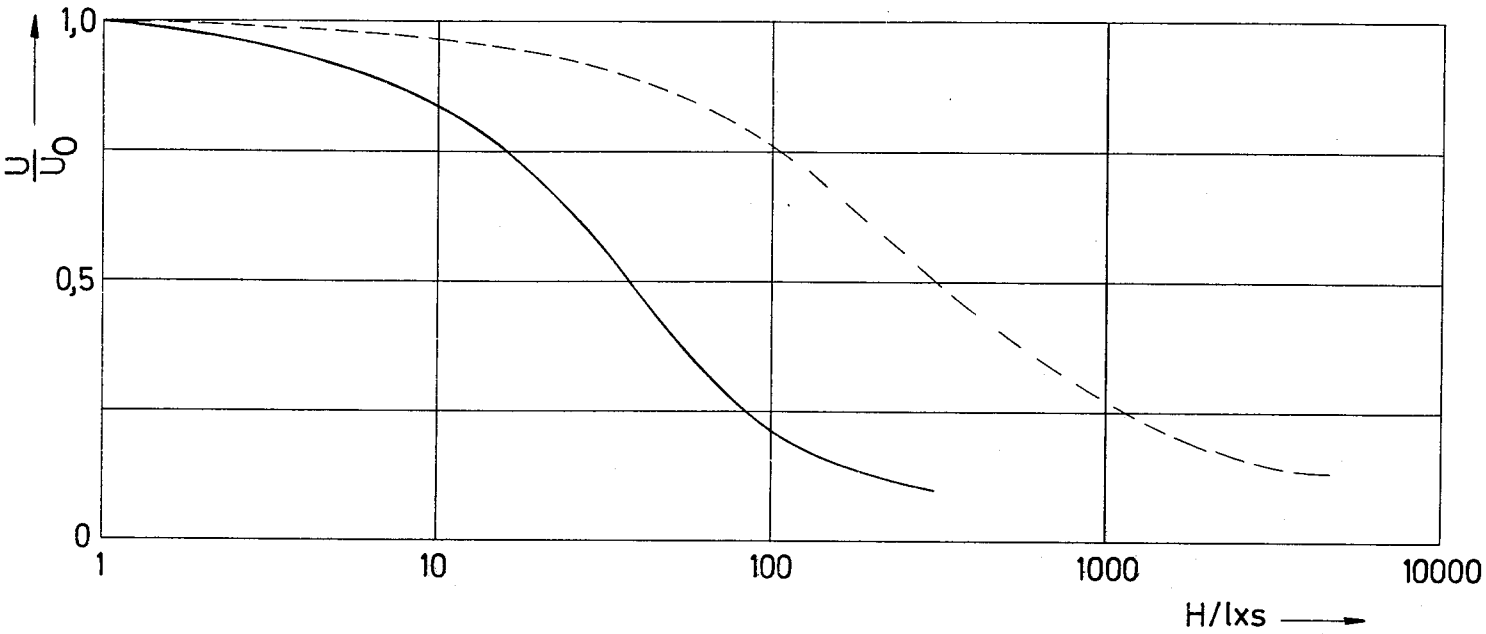

The examples of formulae (4) to (15) may be named as 1,4-bis(styryl)-benzene derivatives suitable in accordance with the invention.

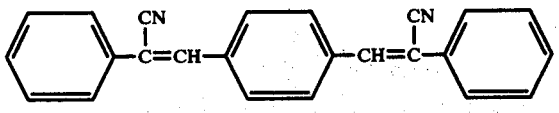

(4)

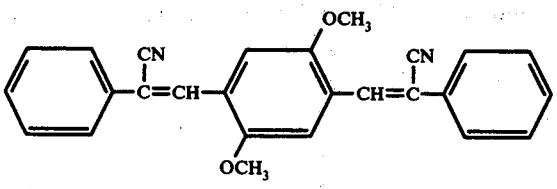

(5)

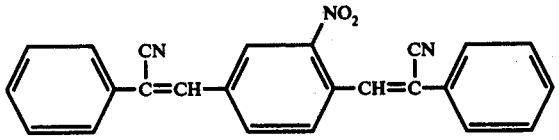

(6)

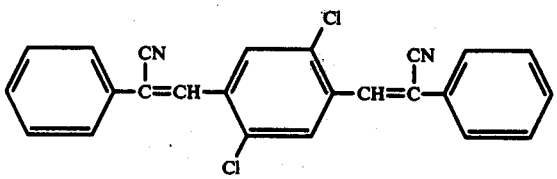

(7)

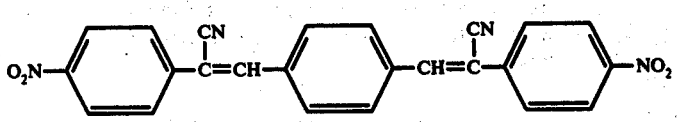

(8)

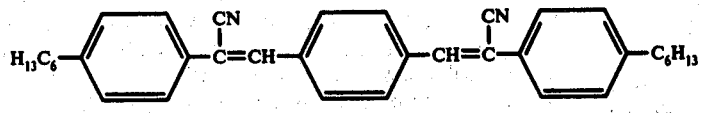

(9)

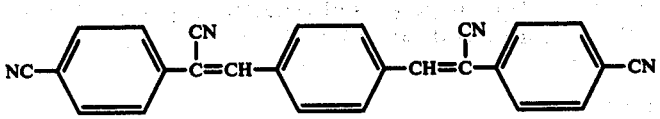

(10)

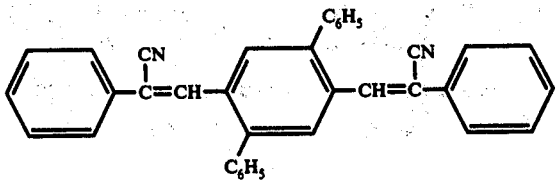

(11)

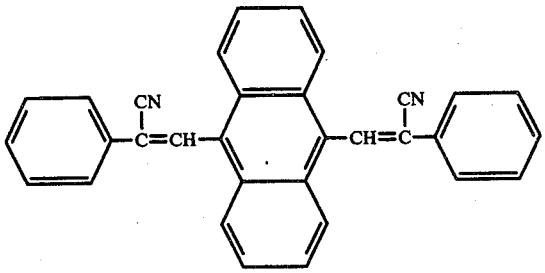
(12)
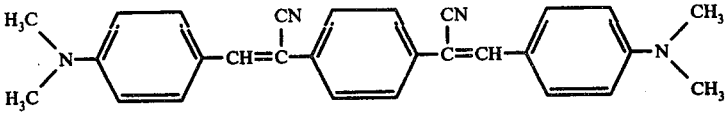
(13)
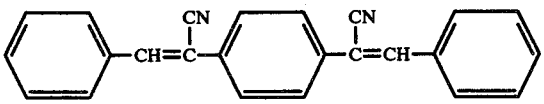
(14)
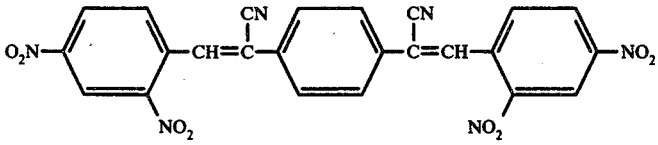
(15)
The examples of formulae (16) to (22) may be named as suitable photoconductive and film-forming polyphenylenevinylenes.
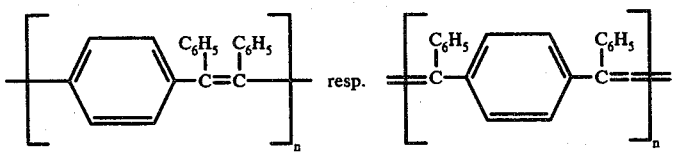
(16)
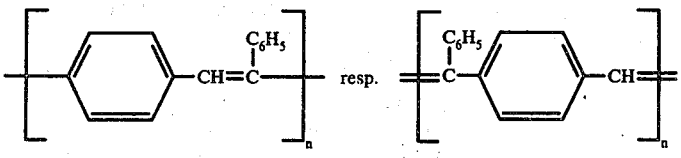
(17)

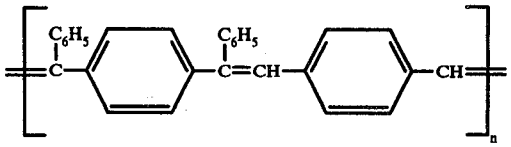

(18)

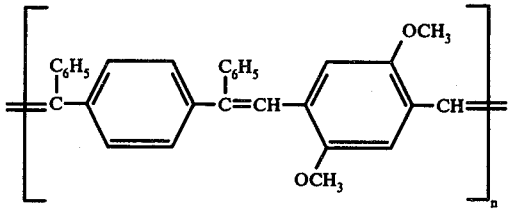

(19)

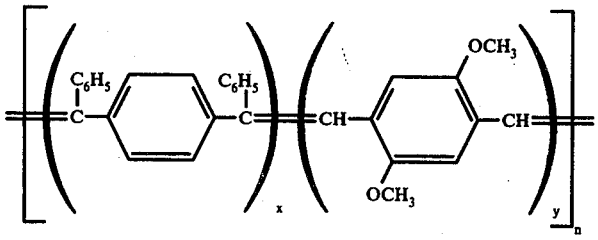

(20)

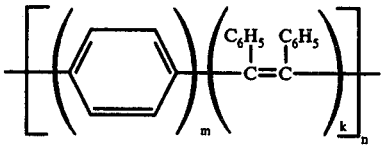

(21)

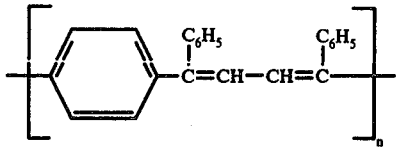

(22)

It is surprising that by the addition of the 1,4-bis-(styryl) benzene derivatives in accordance with the invention a substantial increase is achieved in the electrophotograhic sensitivity of polyphenylenevinylenes.

It should be emphasised as an essential advantage of the electrophotographic recording material in accordance with the invention that such mixed coatings can easily be produced from mixed solutions, but also from melts in special cases, and that the sensitivity-increasing additives are absorbed in relatively high proportions by the polymers without visible unmixing, and thus produce transparent coatings. The utilised photoconductive polymers are also homogeneously miscible with one another, so that high molecular polymers of this kind can serve to improve the mechanical properties. The high chemical and time stability of the photoconductive coatings improved with the additives in accordance with the invention is especially valuable.

The synthesis of the additives takes place in known manner, in the stated examples by condensation of terephthalaldehyde or substituted terephthalaldehyde with benzyl cyanide or substituted benzyl cyanide, or by condensation of p-xylylene-dinitrile with benzaldehyde or substituted benzaldehyde.

The production of the polymers according to formulae (16) to (22) takes place in known manner. Fundamentally the electrophotographic sensitivity of all soluble polyphenylene-vinylenes which form coatings alone or with binding agents can be substantially increased with the additives in accordance with the invention.

Details for the production of the electrophotographic recording material in accordance with the invention and for its properties in the electrophotographic field are contained in the following examples.

EXAMPLE 1

9.64 g of the polyxylylidene of formula (19), $M_n$ = 2,500 g/mol (produced according to D.D.R. Pat. No. 84,272) are dissolved in 300 ml of chloroform and mixed with a solution of 0.36 g of 1,4-bis (α-cyanostyryl)-2,5-dimethoxybenzene (Formula (5)) in 200 ml toluene. This solution is applied to a conductive substratum and after the evaporation of the solvent at 30° . . . 115° C produces a transparent photoconductive coating about 2 μm thick. Such a coating can be charged with the aid of a conventional corona to about 350 V. On exposure with 40 lux the coating is discharged to half potential in 1 s.

In FIG. 1 there is represented by means of the discharge curves the sensitivity gain of a photoconductive coating in accordance with the invention in comparison with a conventional polyxylylidene coating of similar basic substance, which was produced according to Example 2.

EXAMPLE 2

From a solution of 10.0 g of the polyxylylidene of formula (19) designated in Example 1 in 500 ml $CHCl_3$ a transparent photo-conductive coating about 2 μm thick is applied to a conductive substratum.

EXAMPLE 3

9.23 g of the copolymer corresponding to the polyxylylidene formula (20), $M_n$ = 4300 g/mol, which was obtained in accordance with U.S. Pat. No. 101,418 (Example 2) from 50 mol % of 1,4-bis(α-chlorobenzyl) benzene and 50 mol % 2.5-dimethoxy-xylylenedichloride by dehydrohalogenation, are dissolved with 0.77 g of 1,4-bis-(α-cyanostyryl)-2,5-dimethoxybenzene (formula (5)) in 500 ml of toluene.

This solution is applied to a conductive substratum and after evaporation of the solvent produces a transparent photo-conductive coating about 2 μm in thickness. Such a coating can be charged with the aid of a conventional corona to about 350 V. On exposure with 40 lux the coating is discharged to half potential in 1.5 s.

EXAMPLE 4

9.81 g of the copolymer of the polyxylylidene formula (20) designated in example 3 are dissolved with 0.19 g of 1,4-bis(α-cyano-styryl)-2-nitrobenzene (formula (6)) in 500 ml of toluene. From this solution a transparent photoconductive coating about 2 μm in thickness is applied to a conductive substratum. In the electrophotographic field this coating, like those described in the following examples, displays a behaviour similar to the coatings according to Examples 1 and 3.

EXAMPLE 5

6.36 g of the copolymer of the polyxylylidene formula (20) designated in Example 3 are dissolved with 3.11 g of poly-p-αα'-diphenyl-xylylidene, $M_n$ = 35,000 g/mol (produced by dehalogenation of 1,4-bis(dichlorobenzyl)benzene; polyxylylidene formula (16)), and 0.53 g of 1,4-bis(α-cyanostyryl)-2,5-dimethoxybenzene (Formula (5)) in 500 ml of toluene and from this solution applied as a transparent photoconductive coating about 2 μm in thickness to a conductive substratum.

EXAMPLE 6

3.66 g of the copolymer of polyxylylidene Formula (20) designated in Example 3 are dissolved with 0.16 g of 1,4-bis-(α-cyanostyryl)-2,5-dimethoxybenzene (formula (5)) with addition of 10.30 g of silicone varnish NH 12 in 500 ml of toluene, and the photoconductive coating is produced in accordance with Example 3.

EXAMPLE 7

7.58 g of the polyxylylidene of formula (19) designated in Example 1 are dissolved in 300 ml of chloroform and mixed with a solution of 0.57 g of 1,4-bis(α-cyanostyryl)-2,5-dimethoxybenzene (formula (5)) and 1.85 g of poly-p-αα'-diphenylxylylidene, $M_n$ = 35,000 g/mol, polyxylylidene formula (16), in 200 mol of toluene. This solution is applied to a conductive base and after evaporation of the solvents produces a transparent photoconductive coating about 2 μm in thickness.

EXAMPLE 8

9.92 g of the polyxylylidene of formula (19) designated in Example 1 are dissolved in 300 ml of chloroform and mixed with a solution of 0.08 g of 1,4-bis(α-cyanostyryl)-benzene (formula (4)) in 200 ml of toluene. After evaporation of the solvents on a conductive substratum one obtains a transparent photoconductive coating from this solution.

EXAMPLE 9

A solution of 9.92 g of the polyxylylidene of formula (19) designated in Example 1 in 300 ml of chloroform is mixed with a solution of 0.08 g of 1,4-bis(β-cyanostyryl)-benzene (formula (14)) in 200 ml of toluene. After evaporation of the solvents one obtains a transparent photoconductive coating on a conductive substratum.

EXAMPLE 10

9.70 g of poly-p-αα'-diphenyl-xylylidene, $M_n$ = 26,200 g/mol, polyxylylidene formula (16), and 0.30 g of 1,4-bis (α-cyanostyryl)-2,5-dimethoxybenzene (formula (5)) are dissolved in 400 ml of toluene and applied from this solution as a transparent photoconductive coating about 2 μm in thickness to a conductive carrier.

EXAMPLE 11

9.58 g of poly-p-α-phenyl-xylylidene, $M_n$ = 3,200 g/mol, polyxylylidene formula (17), and 0.42 g of 1,4-bis(α-cyanostyryl) 2,5-dimethoxybenzene (formula (5)) are dissolved in 400 ml of toluene and produce a transparent photoconductive coating about 2 μm in thickness on a conductive substratum.

If suitable technologies known per se are used, for example by the addition of plasticisers, the materials in accordance with the invention can also be produced and used in the form of self-supporting films.

We claim:

1. Electrophotographic recording material comprising at least one photoconductive polyphenylenevinylene having a mean molecular weight greater than 2,000 g/mol in admixture with at least one 1,4-bis(styryl) benzene derivative.

2. Electrophotographic recording material according to claim 1, wherein the or each 1,4-bis-(styryl) benzene derivative corresponds to formula (3).

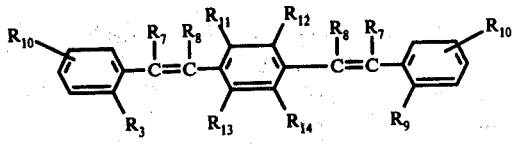

in which at least one of the radicals $R_7$ and $R_8$ signifies a cyano group and the remaining radicals $R_9$ to $R_{14}$ are similar or different and signify hydrogen, cyano, alkoxy, alkyl, aryl, halogen, nitro or amino groups.

3. Electrophotographic recording material according to claim 1, wherein the mass proportion of the or each 1,4-bis(styryl)benzene derivative amounts to 0.5 to 30%.

* * * * *